US011022325B2

(12) United States Patent
Lee et al.

(10) Patent No.: US 11,022,325 B2
(45) Date of Patent: Jun. 1, 2021

(54) AIR CONDITIONER

(71) Applicant: SAMSUNG ELECTRONICS CO., LTD., Suwon-si (KR)

(72) Inventors: Kyeong Ae Lee, Suwon-si (KR); KwonJin Kim, Suwon-si (KR); Sung Jae Kim, Suwon-si (KR); Seon Uk Na, Suwon-si (KR); Yeon Seob Yun, Suwon-si (KR); Young Uk Yun, Suwon-si (KR); Byung Han Lim, Suwon-si (KR); Sung June Cho, Suwon-si (KR); Jong Kweon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 63 days.

(21) Appl. No.: 16/246,713

(22) Filed: Jan. 14, 2019

(65) Prior Publication Data

US 2019/0219278 A1 Jul. 18, 2019

(30) Foreign Application Priority Data

Jan. 15, 2018 (KR) ..... 10-2018-0005149

(51) Int. Cl.
*F24F 1/0033* (2019.01)
*F28G 3/04* (2006.01)
(Continued)

(52) U.S. Cl.
CPC ..... *F24F 1/0033* (2013.01); *B08B 1/04* (2013.01); *F24F 13/20* (2013.01); *F28G 3/04* (2013.01); *F24F 2221/22* (2013.01)

(58) Field of Classification Search
CPC ..... F24F 1/0033; F24F 13/20; F24F 1/005; F24F 1/0011
See application file for complete search history.

(56) References Cited

U.S. PATENT DOCUMENTS 6,460,365 B2 * 10/2002 Kim ..... F24F 1/0007 62/298
2005/0092015 A1 * 5/2005 Park ..... F24F 1/0007 62/419

(Continued)

FOREIGN PATENT DOCUMENTS

JP 2002-349944 12/2002
JP 2005-147496 6/2005

(Continued)

OTHER PUBLICATIONS

PCT International Search Report issued in PCT International Application No. PCT/KR2019/000450 dated May 17, 2019.

(Continued)

*Primary Examiner* — Gordon A Jones
(74) *Attorney, Agent, or Firm* — Staas & Halsey LLP

(57) ABSTRACT

Disclosed is an air conditioner including a housing having a suction port and a discharge port, a discharge panel having a plurality of discharge holes and disposed at the discharge port, a blowing fan provided inside the housing, and a reinforcing member disposed at a rear of the discharge panel to support the discharge panel. With this configuration, it is possible to prevent the discharge panel from being deformed by pressing, and to minimize the exposure of the inside of the air conditioner through the discharge hole of the discharge panel.

8 Claims, 14 Drawing Sheets

(51) Int. Cl.
*F24F 13/20* (2006.01)
*B08B 1/04* (2006.01)

(56) References Cited

U.S. PATENT DOCUMENTS

| | | | | |
|---|---|---|---|---|
| 2014/0053591 | A1* | 2/2014 | Shin | F24F 1/005 62/285 |
| 2019/0001249 | A1* | 1/2019 | Hong | B01D 46/0026 |

FOREIGN PATENT DOCUMENTS

| | | | |
|---|---|---|---|
| JP | 2008-29912 | | 2/2008 |
| JP | 2017-56440 | A | 3/2017 |
| KR | 2003-0056231 | A | 7/2003 |
| KR | 10-2004-0076156 | | 8/2004 |
| KR | 10-2005-0074140 | A | 7/2005 |
| KR | 10-0805418 | | 2/2008 |
| KR | 10-2011-0116864 | | 10/2011 |
| KR | 10-1234828 | | 2/2013 |
| KR | 10-2015-0074511 | | 7/2015 |
| KR | 10-2017-0082863 | A | 7/2017 |

OTHER PUBLICATIONS

PCT Notification of Transmittal of the International Search Report and the Written Opinion of the International Searching Authority, or the Declaration in PCT International Application No. PCT/KR2019/000450 dated May 17, 2019.

PCT Written Opinion of the International Searching Authority in PCT International Application No. PCT/KR2019/000450 dated May 17, 2019.

Extended European Search Report dated Nov. 10, 2020, in corresponding European Patent Application No. 19738757.4.

* cited by examiner

AIR CONDITIONER

CROSS-REFERENCE TO RELATED APPLICATION(S)

This application is based on and claims priority under 35 U.S.C. § 119 to Korean Patent Application No. 10-2018-0005149, filed on Jan. 15, 2018 in the Korean Intellectual Property Office, the disclosure of which is incorporated by reference herein in its entirety.

BACKGROUND

1. Technical Field

The present disclosure relates to an air conditioner capable of variously controlling discharge air flow.

2. Description of the Related Art

An air conditioner is equipped with a compressor, a condenser, an expansion valve, an evaporator, an air blowing fan, and the like, and controls the temperature, humidity and air flow in a room, and the like by using a refrigeration cycle. The air conditioner may include an indoor unit disposed in the room and an outdoor unit disposed outdoors.

The indoor unit of the air conditioner includes a heat exchanger for exchanging heat between a refrigerant and air, an air blowing fan for flowing air, and a motor for driving the air blowing fan to cool or heat the room.

The air blowing fan sucks indoor air, heat-exchanges the indoor air through the heat exchanger, and then discharges the heat-exchanged air back into the room. The air blowing fan has to rotate at a predetermined RPM or higher in consideration of the heat exchange efficiency of the heat exchanger, and the air discharged through a discharge port may be discharged in a direct wind form up to a certain distance.

When this wind contacts a user directly, the user may feel uncomfortable, cold or hot.

SUMMARY

It is an aspect of the present disclosure to provide an air conditioner capable of discharging air in various ways.

It is an aspect of the present disclosure to provide an air conditioner capable of cooling or heating a room while preventing direct wind from reaching a user.

It is an aspect of the present disclosure to provide an air conditioner capable of supplying natural wind that is not heat-exchanged.

It is an aspect of the present disclosure to provide an air conditioner capable of mixing and supplying natural wind and heat-exchanged air.

It is an aspect of the present disclosure to provide an air conditioner in which a discharge panel may be prevented from being deformed by pressing and the exposure of the interior of the air conditioner through discharge holes of the discharge panel may be minimized.

It is an aspect of the present disclosure to provide an air conditioner capable of easily cleaning a rear surface of a discharge panel.

Additional aspects of the present disclosure will be set forth in part in the description which follows and, in part, will be obvious from the description, or may be learned by practice of the disclosure.

In accordance with an aspect of the present disclosure, an air conditioner includes a housing having a suction port and a discharge port, a discharge panel having a plurality of discharge holes and disposed at the discharge port, a heat exchanger to exchange heat with air flowing into the housing, a fan configured to discharge the heat exchanged air out of the housing and a reinforcing member disposed at a rear of the discharge panel to support the discharge panel and guide the air that has passed through the heat exchanger to the discharge panel.

The reinforcing member may include a plurality of unit cells continuously arranged to be adjacent to each other on one plane, and each of the unit cells may include a partition and a through hole formed to be surrounded by the partition.

The reinforcing member may be disposed to be spaced apart from the discharge panel by a predetermined gap.

The cross-sectional area of the through-hole may be within a range of 5 to 10 times the cross-sectional area of the discharge hole.

The unit cells may have a hexagonal, rectangular, or triangular shape.

The reinforcing member may include a reinforcing portion having the plurality of unit cells, and a frame portion formed at an edge of the reinforcing portion.

The air conditioner may further include a support frame coupled to an edge of the reinforcing member to fix and support the reinforcing member.

The support frame may include a front support portion protruding to support a front surface of the reinforcing member and a rear support portion protruding to support a rear surface of the reinforcing member.

The reinforcing member may include through holes and a louver configured to be rotatable to open and close the through holes.

The reinforcing member may include a plurality of the louvers arranged in a vertical direction, and the louvers may be configured to be rotatable up and down about a rotational shaft disposed in a horizontal direction.

The air conditioner may further include a cleaning brush provided between the discharge panel and the reinforcing member to clean a rear surface of the discharge panel.

The cleaning brush may be configured to move in a vertical direction between the discharge panel and the reinforcing member.

The discharge panel may include guide grooves formed on opposite sides of the discharge panel in the vertical direction to guide the movement of the cleaning brush.

The cleaning brush may include a brush shaft inserted into the guide grooves, and brush bristles provided on an outer circumferential surface of the brush shaft.

The cleaning brush may include a handle provided to allow a user to manually move the cleaning brush.

In accordance with another aspect of the present disclosure, an air conditioner includes a housing having a suction port and a discharge port, a discharge panel having a plurality of discharge holes and disposed at the discharge port, a blowing fan provided inside the housing to suck air into the housing through the suction port and to discharge air to the outside of the housing through the plurality of discharge holes, and a cleaning brush provided at a rear of the discharge panel in a vertical direction to clean a rear surface of the discharge panel.

The discharge panel may include guide grooves formed on opposite sides of the discharge panel in the vertical direction to guide the movement of the cleaning brush.

The cleaning brush may include a brush shaft inserted into the guide grooves, and brush bristles provided on an outer circumferential surface of the brush shaft to be in contact with a rear surface of the discharge panel.

The cleaning brush may include a handle provided to allow a user to manually move the cleaning brush.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
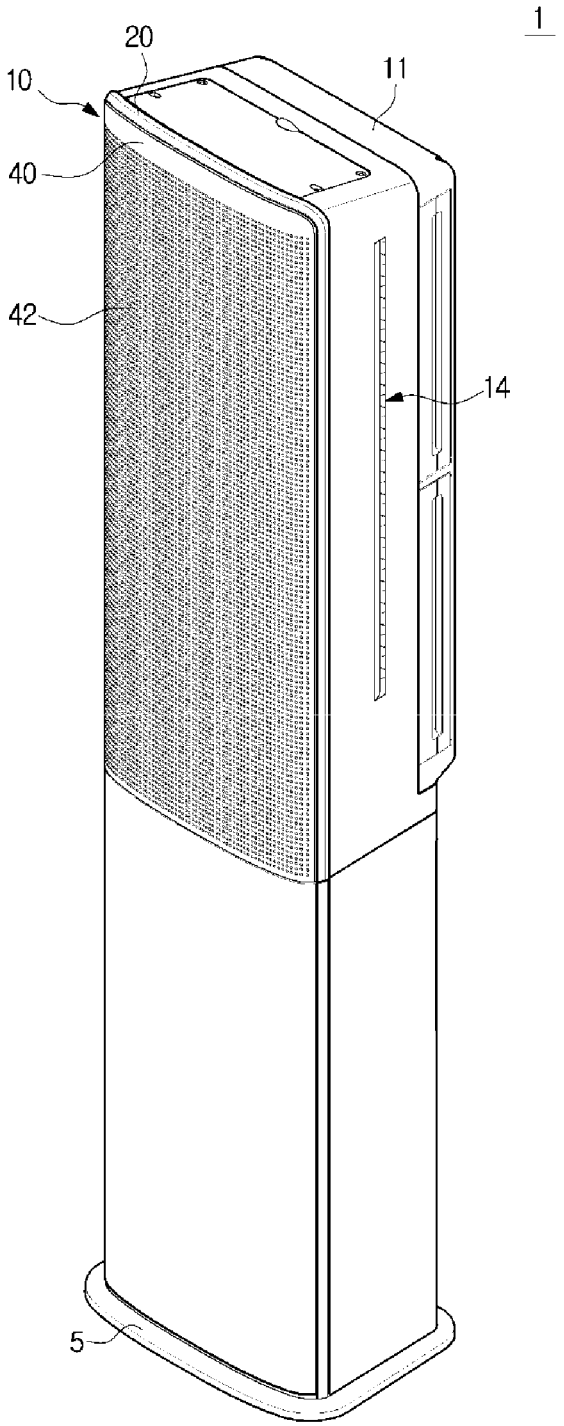
FIG. 1 is a perspective view of an air conditioner according to an embodiment of the present disclosure.

The embodiments described herein and the configurations shown in the drawings are only examples of preferred embodiments of the present disclosure, and various modifications may be made at the time of filing of the present disclosure to replace the embodiments and drawings of the present specification.

It is to be understood that the singular forms "a," "an," and "the" include plural referents unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component.

Hereinafter, preferred embodiments of the present disclosure will be described in detail with reference to the accompanying drawings.

Figure 2:
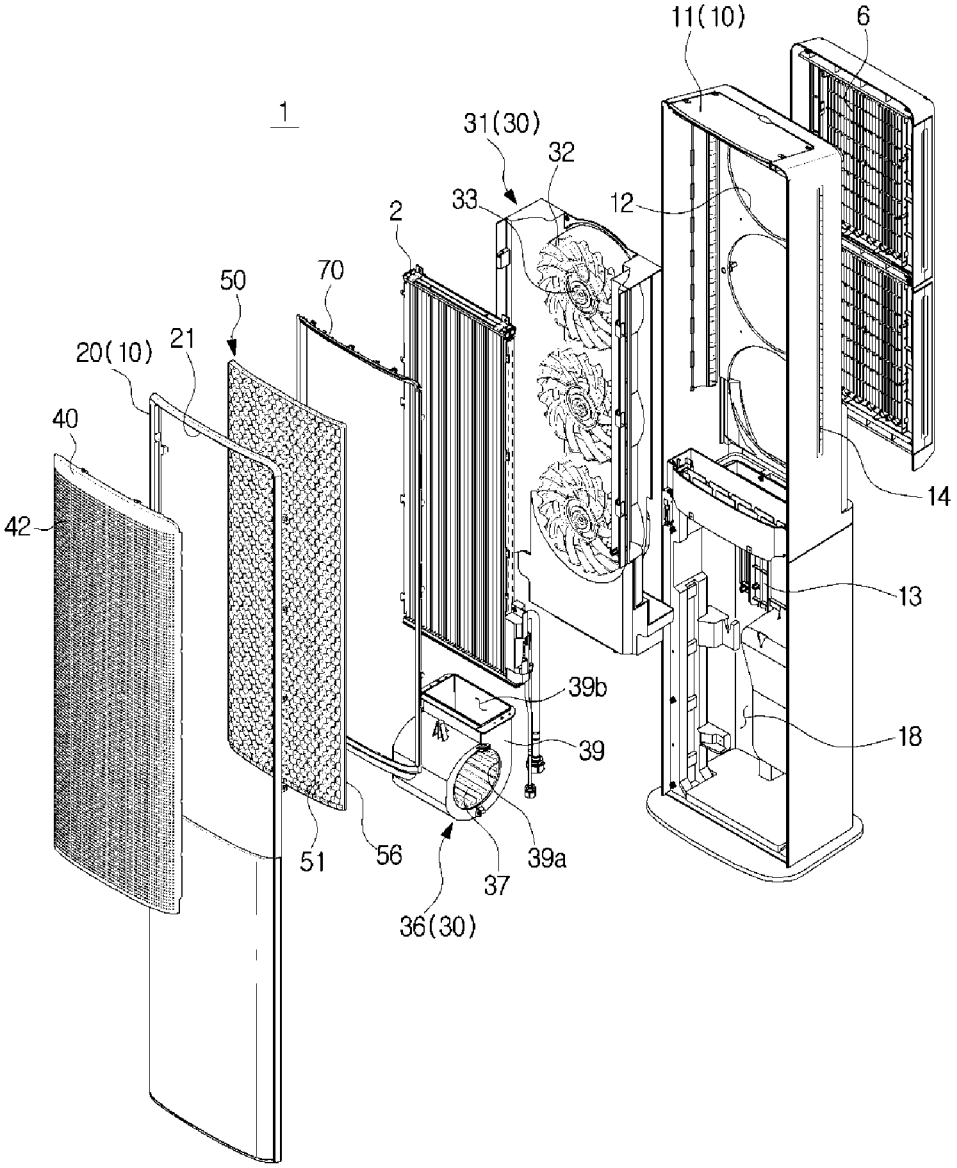
FIG. 2 is an exploded perspective view of main configurations of the air conditioner in FIG. 1.
Figure 3:
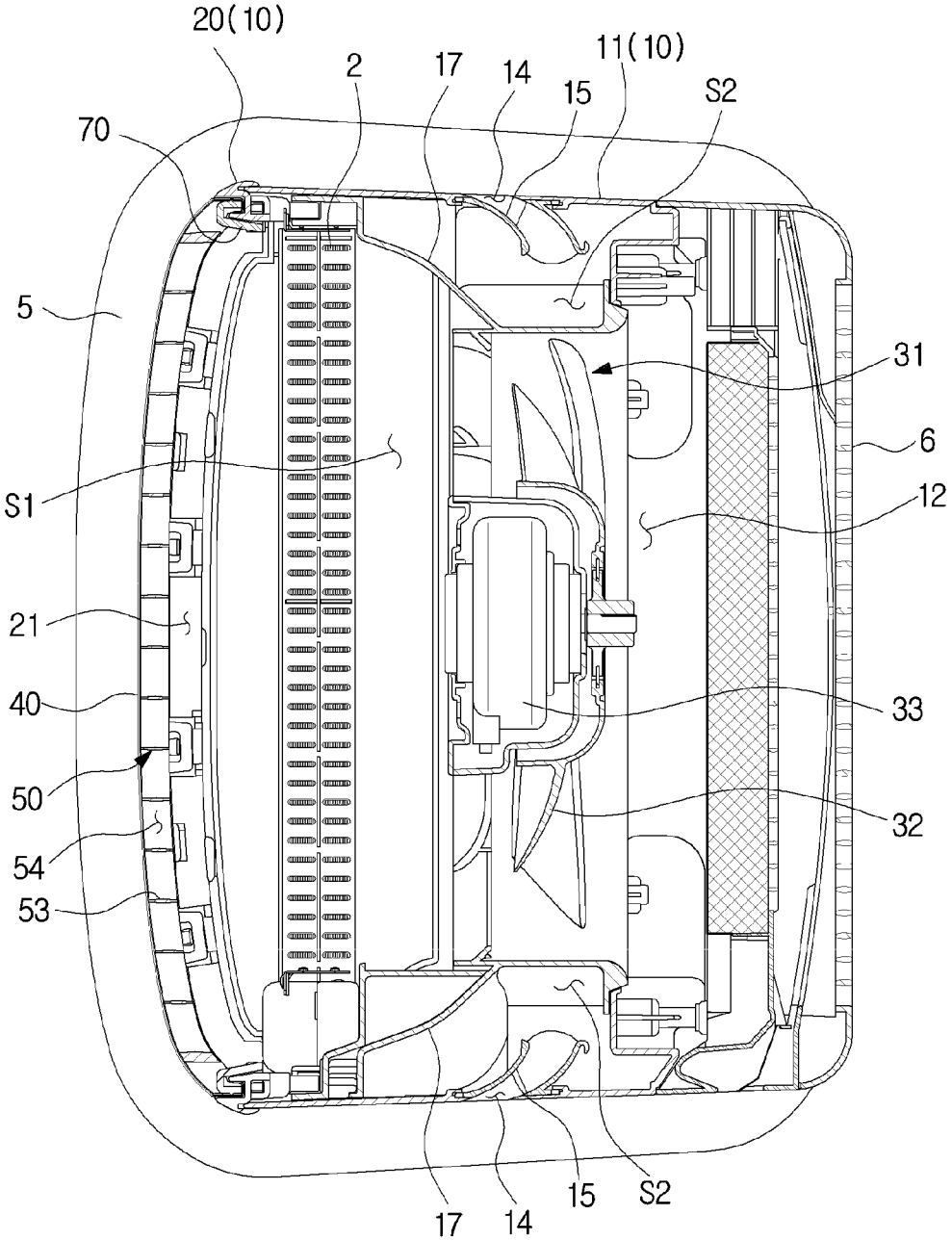
FIG. 3 is a plan sectional view of main configurations of the air conditioner in FIG. 1.
Figure 4:
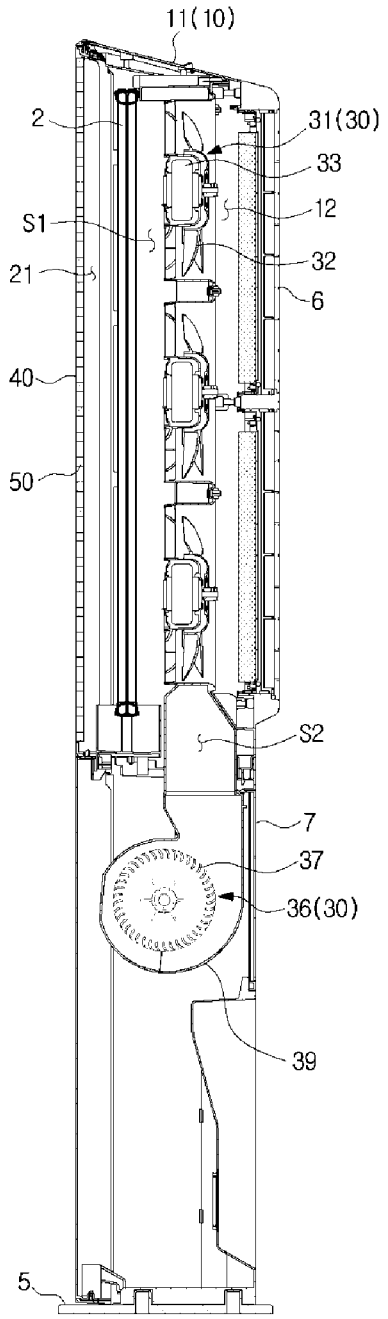
FIG. 4 is a side sectional view of main configurations of the air conditioner in FIG. 1.

FIG. 1 is a perspective view of an air conditioner according to an embodiment of the present disclosure, FIG. 2 is an exploded perspective view of main configurations of the air conditioner in FIG. 1, FIG. 3 is a plan sectional view of main configurations of the air conditioner in FIG. 1, and FIG. 4 is a side sectional view of main configurations of the air conditioner in FIG. 1.

Referring to FIGS. 1 to 4, an air conditioner 1 may include a housing 10 for forming an outer appearance, an air blowing device 30 provided to flow air into or out of the housing 10, and a heat exchanger 2 provided to heat-exchange the air introduced into the housing 10.

The housing 10 may include a casing 11 on which the air blowing device 30 and the heat exchanger 2 are mounted, and a front panel 20 coupled to a front surface of the casing 11. The casing 11 is opened on a front side and the opened front side may be covered by the front panel 20. The front panel 20 may be detachably coupled to the casing 11.

The casing 11 may be provided with at least one first suction port 12. The first suction port 12 may be formed on an upper portion of a rear surface of the casing 11. External air may be introduced into the housing 10 through the first suction port 12.

The front panel 20 may be provided with at least one first discharge port 21. The first discharge port 21 may be formed on an upper portion of the front panel 20. The first discharge port 21 may be formed at a height corresponding to the height of the first suction port 12. Exchanged air via the heat exchanger 2 may be discharged to the outside of the housing 10 through the first discharge port 21. The first discharge port 21 may discharge the air introduced through the first suction port 12.

In this embodiment, the air conditioner 1 has three of the first suction ports 12, but the number of the first suction ports 12 is not limited thereto. In this embodiment, the first suction port 12 is formed in a circular shape, but the shape of the first suction port 12 is not limited thereto.

The casing 11 may be provided with at least one second suction port 13. The second suction port 13 may be formed on a lower portion of a rear surface of the casing 11. The second suction port 13 may be formed on a lower side of the first suction port 12. External air may be introduced into the housing 10 through the second suction port 13. The number and shape of the second suction ports 13 are also not limited and may be formed in many numbers and various shapes.

The first suction port 12 may be equipped with a first suction grill 6 to prevent foreign matter from being sucked through the first suction port 12. The second suction port 13 may be equipped with a second suction grill 7 to prevent foreign matter from being sucked through the second suction port 13.

The casing 11 may be provided with at least one second discharge port 14. The second discharge port 14 may be formed on a side surface of the casing 11. The second discharge port 14 may be formed on an upper portion of the side surface of the casing 11. The second discharge port 14 may be formed at a height corresponding to the height of the first discharge port 21.

The second discharge port 14 may be formed long in a vertical direction. The air which has not been heat-exchanged inside the housing 10 may be discharged to the outside of the housing 10 through the second discharge port 14. The second discharge port 14 may discharge the air introduced through the second suction port 13.

The casing 11 may have a curved surface guide 15 for guiding air discharged from the second discharge port 14. The curved surface guide 15 may guide the air discharged from the second discharge port 14 through the Coanda effect. The curved surface guide 15 may be provided to guide the air discharged through the second discharge port 14 forward. Thus, the air discharged through the second discharge port 14 may be mixed with the air discharged from the first discharge port 21.

The air conditioner 1 may include a first flow passage S1 for connecting the first suction port 12 and the first discharge port 21 and a second flow passage S2 for connecting the second suction port 13 and the second discharge port 14. The first flow passage S1 and the second flow passage S2 may be partitioned from each other. Accordingly, the air flowing through the first flow passage S1 and the air flowing through the second flow passage S2 may not be mixed.

Specifically, the first flow passage S1 and the second flow passage S2 may be partitioned by a partition plate 17. The partition plate 17 may be formed long in a vertical direction inside the housing 10.

The air conditioner 1 may be configured such that the air that has been heat-exchanged through the heat exchanger 2 is discharged through the first discharge port 21 and the air that has not been passed through the heat exchanger 2 is discharged through the second discharge port 14. Since the heat exchanger 2 is disposed on the first flow passage S1, the air discharged through the first discharge port 21 may be air that has been heat-exchanged. Since a heat exchanger is not disposed on the second flow passage S2, the air discharged through the second discharge port 14 may be air that has not been heat-exchanged.

A support stand 5 may be provided at a lower end of the housing 10 to stably support the air conditioner 1. An accommodating space 18 is formed in the casing 11, and a second blowing unit 36 and various electrical components necessary for driving the air conditioner 1 may be disposed in the accommodating space 18.

The air blowing device 30 may include a first blowing unit 31 and the second blowing unit 36. The first blowing unit 31 and the second blowing unit 36 may be driven independently of each other.

The first blowing unit 31 may be disposed on the first flow passage S1 formed between the first suction port 12 and the first discharge port 21. Air may be introduced into the housing 10 through the first suction port 12 by the first blowing unit 31. The air introduced through the first suction port 12 may be moved along the first flow passage S1 and discharged to the outside of the housing 10 through the first discharge port 21. The first blowing unit 31 may include a first blowing fan 32 and a first fan driver 33.

The first blowing fan 32 may be an axial flow fan or a mixed flow fan. However, the type of the first blowing fan 32 is not limited thereto. The first fan driver 33 may drive the first blowing fan 32. The first fan driver 33 may be disposed at a center portion of the first blowing fan 32. The first fan driver 33 may include a motor.

The second blowing unit 36 may be disposed on the second flow passage S2 formed between the second suction port 13 and the second discharge port 14. Air may be introduced into the housing 10 through the second suction port 13 by the second blowing unit 36. The air introduced through the second suction port 13 may be moved along the second flow passage S2 and discharged to the outside of the housing 10 through the second discharge port 14.

The second blowing unit 36 may include a second blowing fan 37, a second fan driver, and a fan case 39.

The second blowing fan 37 may be a centrifugal fan. However, the type of the second blowing fan 37 is not limited thereto. The second fan driver may drive the second blowing fan 37. The second fan driver may include a motor.

The fan case 39 may cover the second blowing fan 37 and guide air. The fan case 39 may have a fan inlet 39*a* into which air flows and a fan outlet 39*b* through which air is discharged.

The heat exchanger 2 may be disposed between the first blowing unit 31 and the first discharge port 21. The heat exchanger 2 may be disposed on the first flow passage S1. The heat exchanger 2 may absorb heat from the air introduced through the first suction port 12 or transfer the heat to the air introduced through the first suction port 12. The heat exchanger 2 may include headers, tubes through which a refrigerant flows, and heat exchange fins attached to the tubes to increase the heat transfer area.

The air conditioner 1 may include a discharge panel 40 that is mounted on the first discharge port 21 of the front panel 20. The discharge panel 40 may have a plurality of discharge holes 42 passing through the discharge panel 40. Since the air guided to the first discharge port 21 is discharged to the outside of the housing 10 through the plurality of discharge holes 42, the discharge speed may be reduced.

The plurality of discharge holes 42 are of a minute size and may be uniformly distributed over the entire area of the discharge panel 40. The wind blown out through the plurality of discharge holes 42 does not directly reach the user, and may gradually cool or heat a room.

The thickness of the discharge panel 40 needs to be made sufficiently thin so as to improve the workability of the plurality of discharge holes 42 and to prevent the speed of the air passing through the plurality of discharge holes 42 from being too slow. The thickness of the discharge panel 40 may be approximately 0.6 mm. As described above, since the discharge panel 40 is thin, the discharge panel 40 may be vulnerable to external impact. That is, when the discharge panel 40 is pressed from the outside, a dent or other deformation may occur in the discharge panel 40. In addition, the inside of the air conditioner 1 may be seen from the outside through the discharge holes 42 of the discharge panel 40. Since the heat exchanger 2 is disposed at a rear of the discharge panel 40, the heat exchanger 2 may be exposed to the outside through the discharge holes 42 of the discharge panel 40, thereby lowering the esthetic sense.

According to an embodiment of the present disclosure, the air conditioner 1 may include a reinforcing member 50 disposed at a rear of the discharge panel 40 to prevent the deformation of the discharge panel 40 and to minimize the exposure of the inside of the air conditioner 1.

The reinforcing member 50 (which may be a panel as shown in various of the figures such as, for example, FIGS. 2, 6, 11, 12 and 13) may include a reinforcing portion 51 provided to support the discharge panel 40 and a frame portion 56 formed at an edge of the reinforcing portion 51 to support the reinforcing portion 51.

The air conditioner 1 may also include a support frame 70 that is coupled to the reinforcing member 50 to fix and support the reinforcing member 50.

Hereinafter, a specific configuration of the reinforcing member 50 and the support frame 70 will be described in detail.

Figure 5:
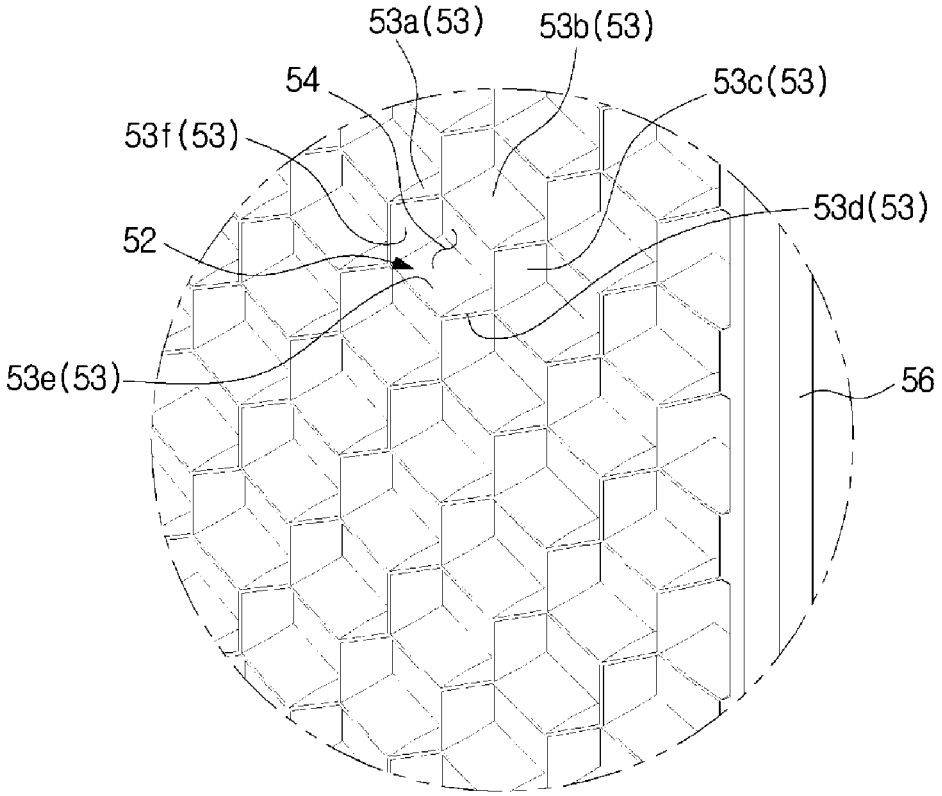
FIG. 5 is an enlarged view of a part of a reinforcing member of the air conditioner in FIG. 1.
Figure 6:
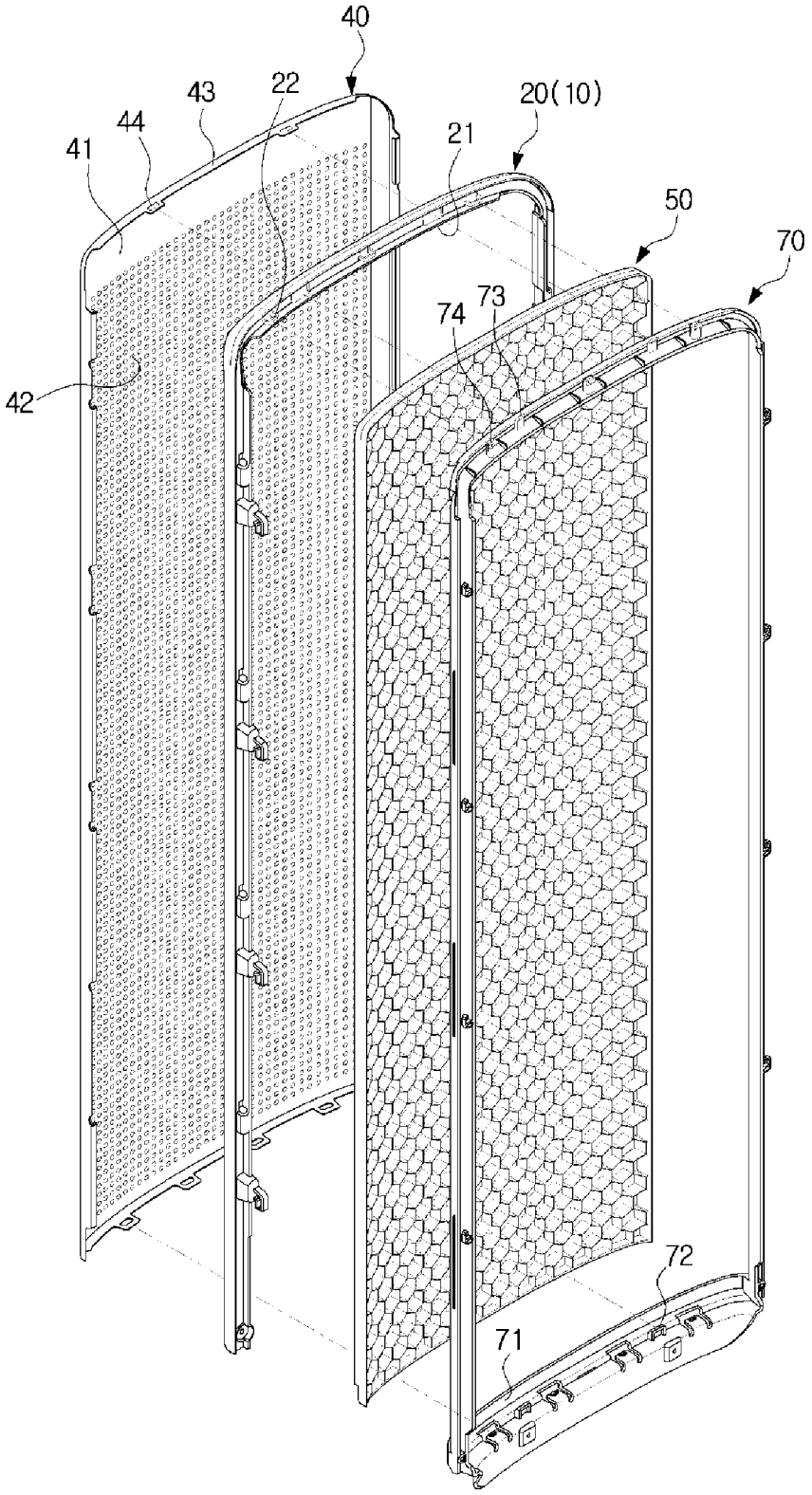
FIG. 6 is a view illustrating a state in which a discharge panel, a front panel, a reinforcing member, and a support frame of the air conditioner in FIG. 1 are separated.
Figure 7:
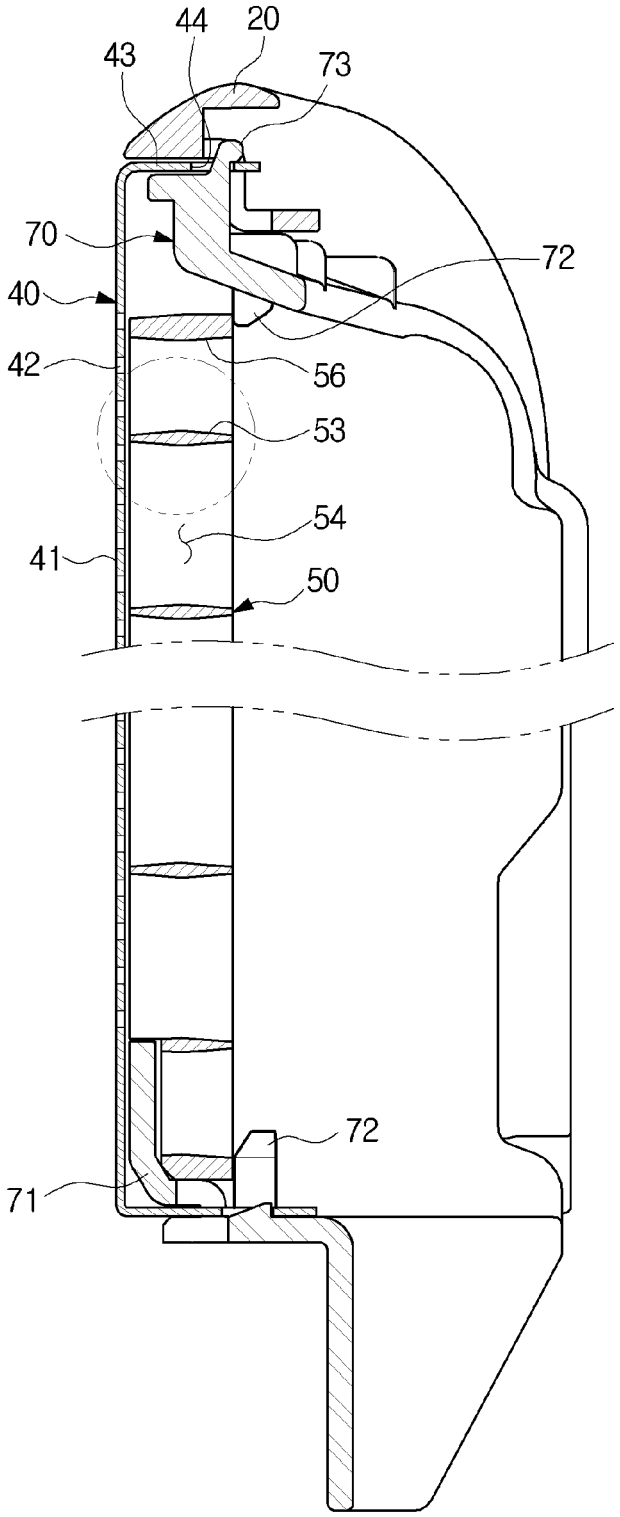
FIG. 7 is a side sectional view illustrating a state in which a discharge panel, a front panel, a reinforcing member, and a support frame of the air conditioner in FIG. 1 are coupled to each other.
Figure 8:
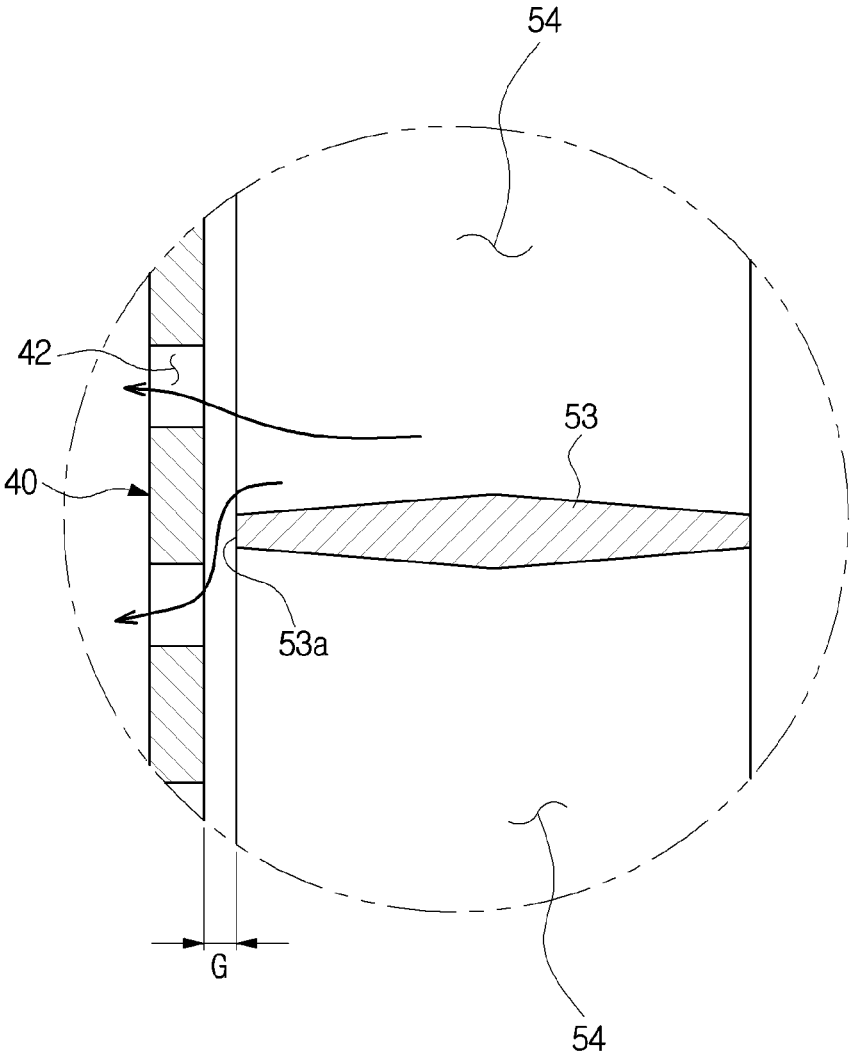
FIG. 8 is an enlarged view of a dotted line portion in FIG. 7.

FIG. 5 is an enlarged view of a part of a reinforcing member of the air conditioner in FIG. 1, FIG. 6 is a view illustrating a state in which a discharge panel, a front panel, a reinforcing member, and a support frame of the air conditioner in FIG. 1 are separated, FIG. 7 is a side sectional view illustrating a state in which a discharge panel, a front panel, a reinforcing member, and a support frame of the air conditioner in FIG. 1 are coupled to each other, and FIG. 8 is an enlarged view of a dotted line portion in FIG. 7.

Referring to FIGS. 5 to 8, the reinforcing portion 51 of the reinforcing member 50 may be composed of a plurality of unit cells 52 continuously arranged to be adjacent to each other on one plane. Each of the unit cells 52 may include a partition 53 having a predetermined thickness and a through hole 54 formed to be surrounded by the partition 53.

The unit cells 52 may have a honeycomb shape, i.e., a hexagonal shape. That is, the partition 53 may include six unit walls 53*a*, 53*b*, 53*c*, 53*d*, 53*e*, and 53*f*. Such a honeycomb shape, as is known, forms a stable structure that is resistant to twisting, pressing, etc., while consuming a small amount of material and smoothly flowing air.

The reinforcing member 50 may be disposed to be spaced apart from the discharge panel 40 by a predetermined gap G (refer to FIG. 8). The discharge panel 40 may be supported in contact with the unit wall 53*a* of the partition 53 forming a front support surface when the discharge panel 40 is depressed by external pressure. That is, the partition 53 may restrict a depressed amount of the discharge panel 40 when the discharge panel 40 is depressed by external pressure.

The air that has been heat-exchanged through the heat exchanger 2 may be guided to the discharge panel 40 side through the through holes 54 of the reinforcing member 50. Since the reinforcing member 50 is disposed to be spaced apart from the discharge panel 40 by the predetermined gap G, the partition 53 of the reinforcing member 50 is prevented from clogging the discharge holes 42 of the discharge panel 40 and air may smoothly escape from the discharge holes 42 as shown by arrows in FIG. 8.

The cross-sectional area of the through holes 54 of the reinforcing member 50 needs to be appropriately designed so as to secure sufficient strength without disturbing the flow of air and may be determined within a range of about 5 to 10 times the cross-sectional area of the discharge holes 42.

The support frame 70 may be coupled to the reinforcing member 50 to fix and support the reinforcing member 50. The support frame 70 has a substantially rectangular frame shape and may include a front support portion 71 (refer to FIGS. 6 and 7) protruding to support a front surface of the reinforcing member 50 and a rear support portion 72 (refer to FIGS. 6 and 7) protruding to support a rear surface of the reinforcing member 50.

An assembly in which the reinforcing member 50 and the support frame 70 are coupled to each other may be combined with the discharge panel 40 again. The discharge panel 40 may include a front portion 41 on which the plurality of discharge holes 42 are formed and a coupling portion 43 extending from the front portion 41 to mount the discharge panel 40 to the first discharge port 21, and the coupling portion 43 may have coupling grooves 44.

The support frame 70 may have coupling ribs 73 that are inserted into and coupled to the coupling grooves 44 of the discharge panel 40. Thus, by having the coupling ribs 73 inserted into the coupling grooves 44, the assembly of the reinforcing member 50 and the support frame 70 may be combined with the discharge panel 40.

An assembly in which the discharge panel 40, the reinforcing member 50 and the support frame 70 are coupled to each other may be mounted to the first discharge port 21 of the front panel 20 again. To this end, the front panel 20 may be formed with coupling grooves 22 (refer to FIG. 6), and the support frame 70 may be formed with coupling hooks 74 which are inserted into and coupled to the coupling grooves 22. The assembly in which the discharge panel 40, the reinforcing member 50 and the support frame 70 are coupled to each other may be detachably mounted to the first discharge port 21 of the front panel 20.

Figure 9:
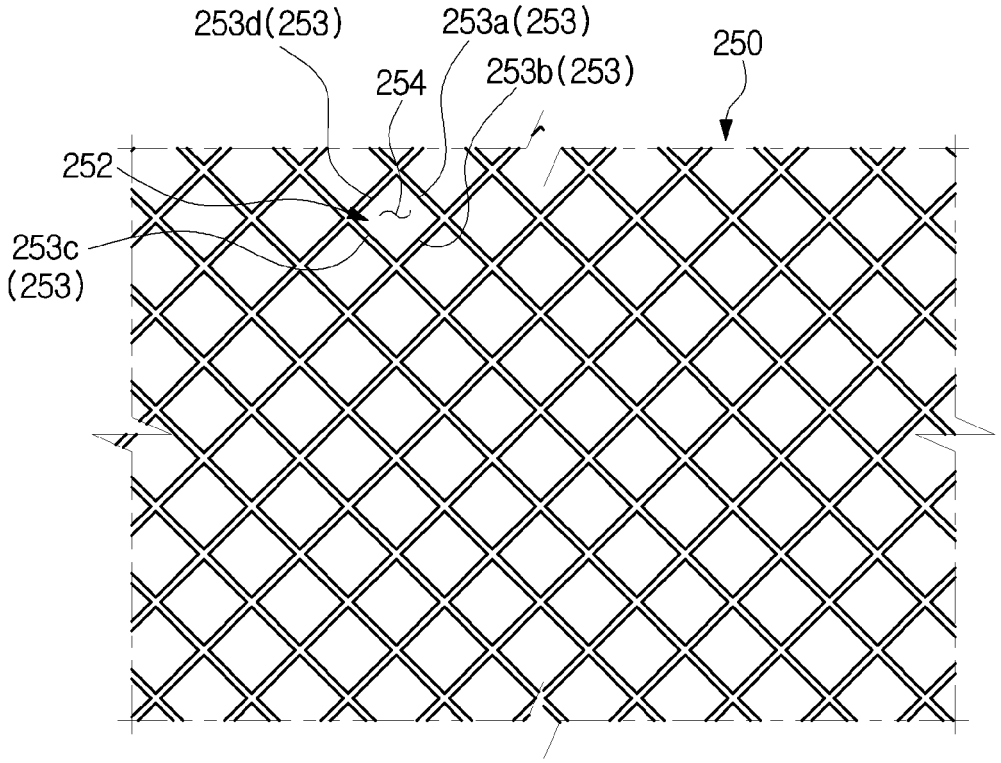
FIG. 9 is a view illustrating a reinforcing member according to another embodiment of the present disclosure, in which the reinforcing member includes unit cells of a rectangular shape.
Figure 10:
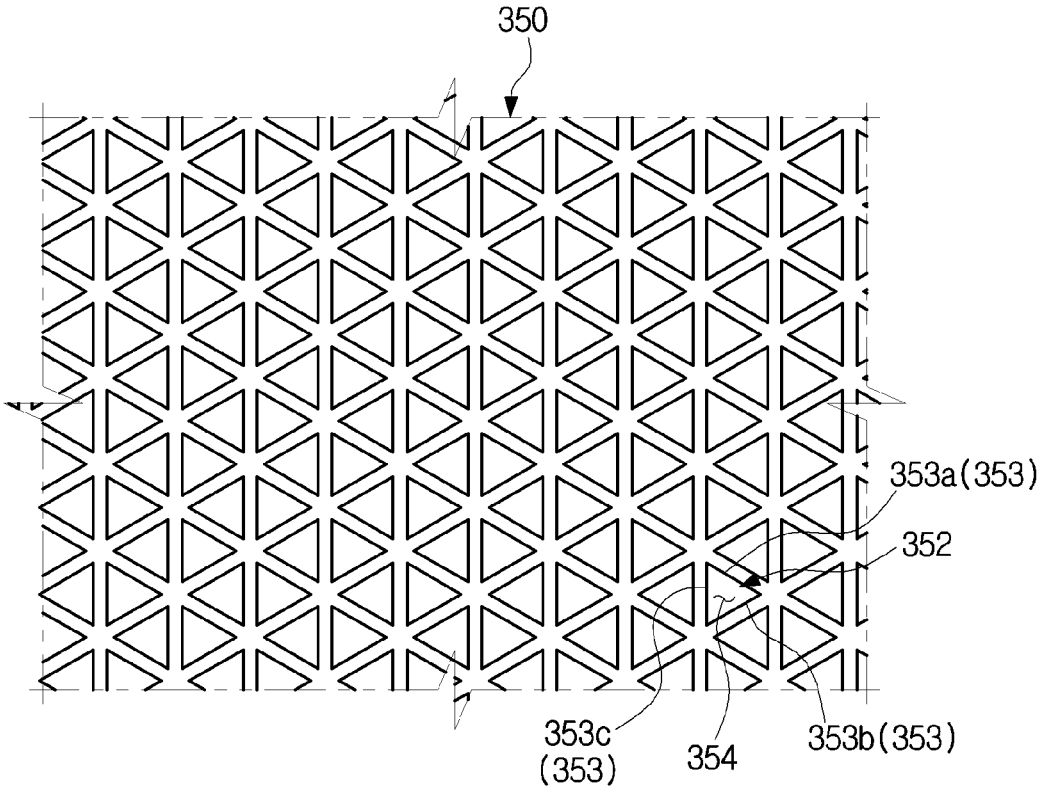
FIG. 10 is a view illustrating a reinforcing member according to another embodiment of the present disclosure, in which the reinforcing member includes unit cells of a triangular shape.
Figure 11:
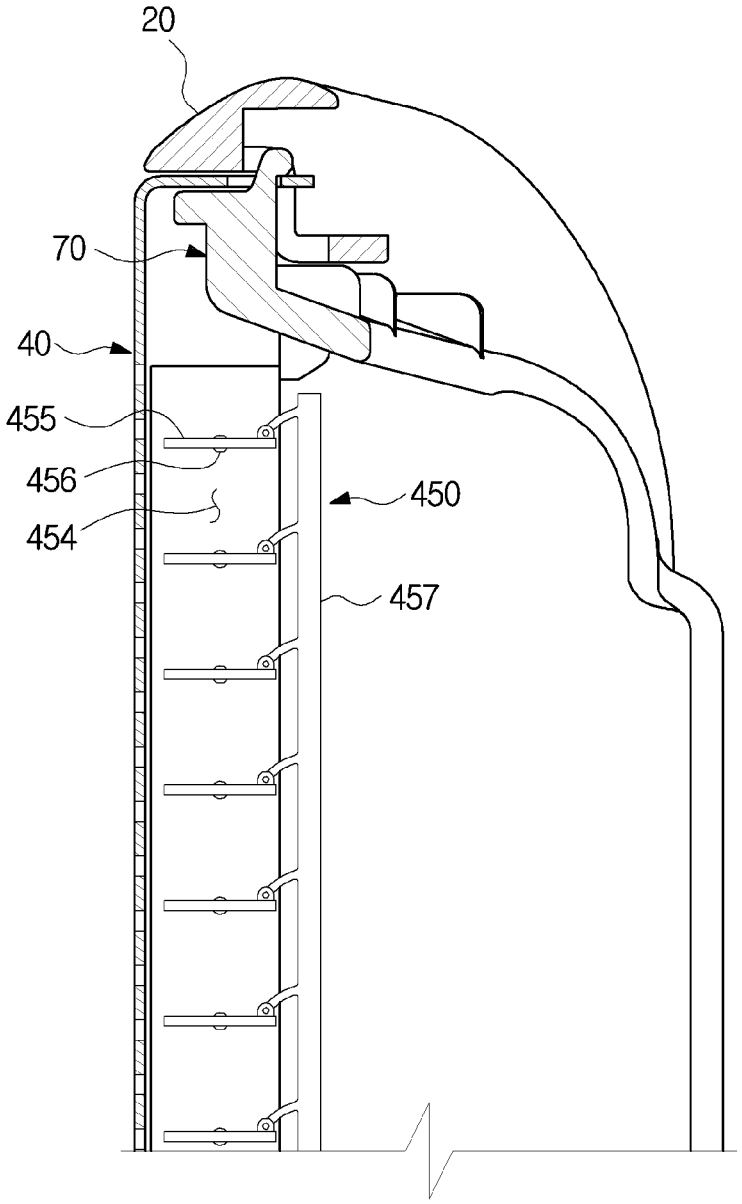
FIGS. 11 and 12 are views illustrating operations of a reinforcing member according to another embodiment of the present disclosure, in which the reinforcing member includes rotatable louvers.
Figure 12:
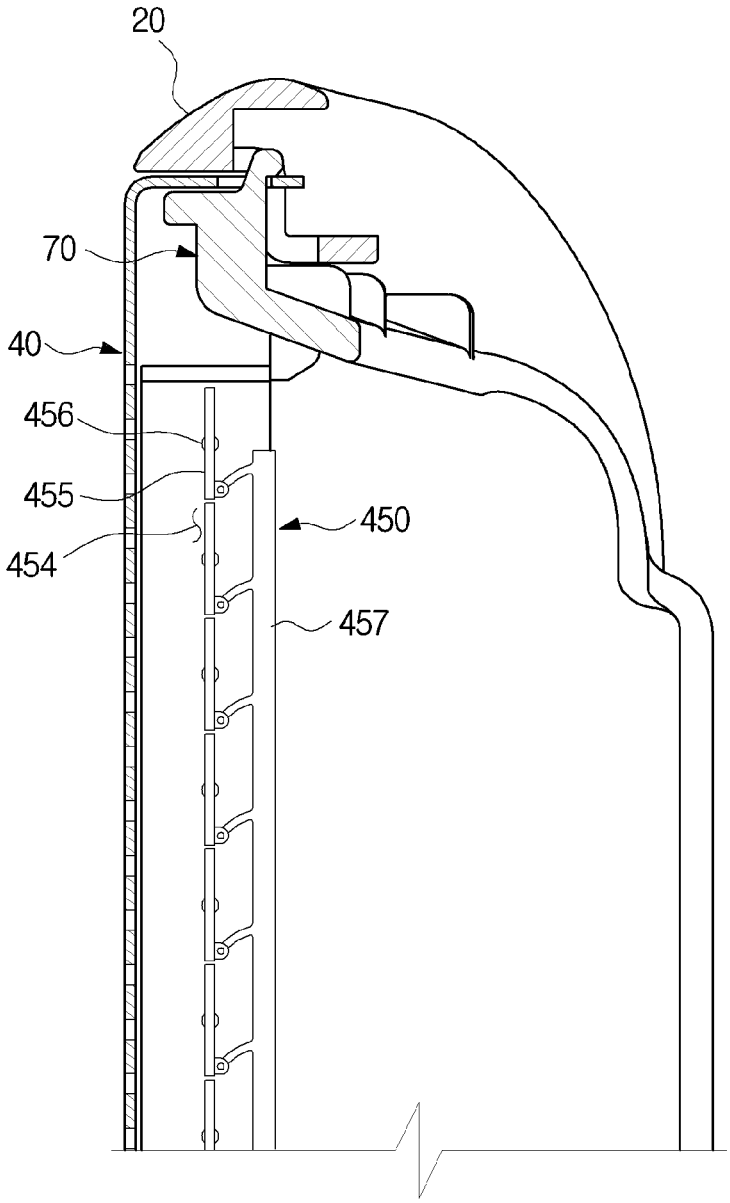

FIG. 9 is a view illustrating a reinforcing member according to another embodiment of the present disclosure, in which the reinforcing member includes unit cells of a rectangular shape, FIG. 10 is a view illustrating a reinforcing member according to another embodiment of the present disclosure, in which the reinforcing member includes unit cells of a triangular shape, and FIGS. 11 and 12 are views illustrating operations of a reinforcing member according to another embodiment of the present disclosure, in which the reinforcing member includes rotatable louvers.

The same reference numerals are given to the same components as those of the above-described embodiment, and description thereof may be omitted.

As illustrated in FIG. 9, unit cells 252 of a reinforcing member 250 may have a rectangular shape or a rhombus shape. Each of the unit cells 252 may include a partition 253 having a predetermined thickness and a through hole 254 formed to be surrounded by the partition 253.

The partition 253 and the through hole 254 of each of the unit cells 252 may have a rectangular shape or a rhombus shape. That is, the partition 253 may include four unit walls 253*a*, 253*b*, 253*c*, and 253*d*.

As illustrated in FIG. 10, unit cells 352 of a reinforcing member 350 may have a triangular shape. Each of the unit cells 352 may include a partition 353 having a predetermined thickness and a through hole 354 formed to be surrounded by the partition 353.

The partition 353 and the through hole 354 of each of the unit cells 352 may have a triangular shape. That is, the partition 353 may include three unit walls 353*a*, 353*b* and 353*c*.

As illustrated in FIGS. 11 and 12, a reinforcing member 450 may include through holes 454 formed to guide the air that has passed through the heat exchanger 2 to the discharge panel 40, and louvers 455 provided to open and close the through holes 454.

A plurality of the louvers 455 may be arranged in a vertical direction. The louvers 455 may be rotatably provided. The louvers 455 may be configured to be rotatable up and down about a rotation axis 456 disposed in a horizontal direction. An actuating bar 457 is connected to the louvers 455 so that the louvers 455 may be rotated as the actuating bar 457 moves.

As illustrated in FIG. 11, the louvers 455 open the through holes 454 to allow air to flow smoothly when the air conditioner 1 is operated, and as illustrated in FIG. 12, the louvers 455 may close the through holes 454 to prevent the inside of the air conditioner 1 from being exposed when the air conditioner 1 is not operated.

Figure 13:
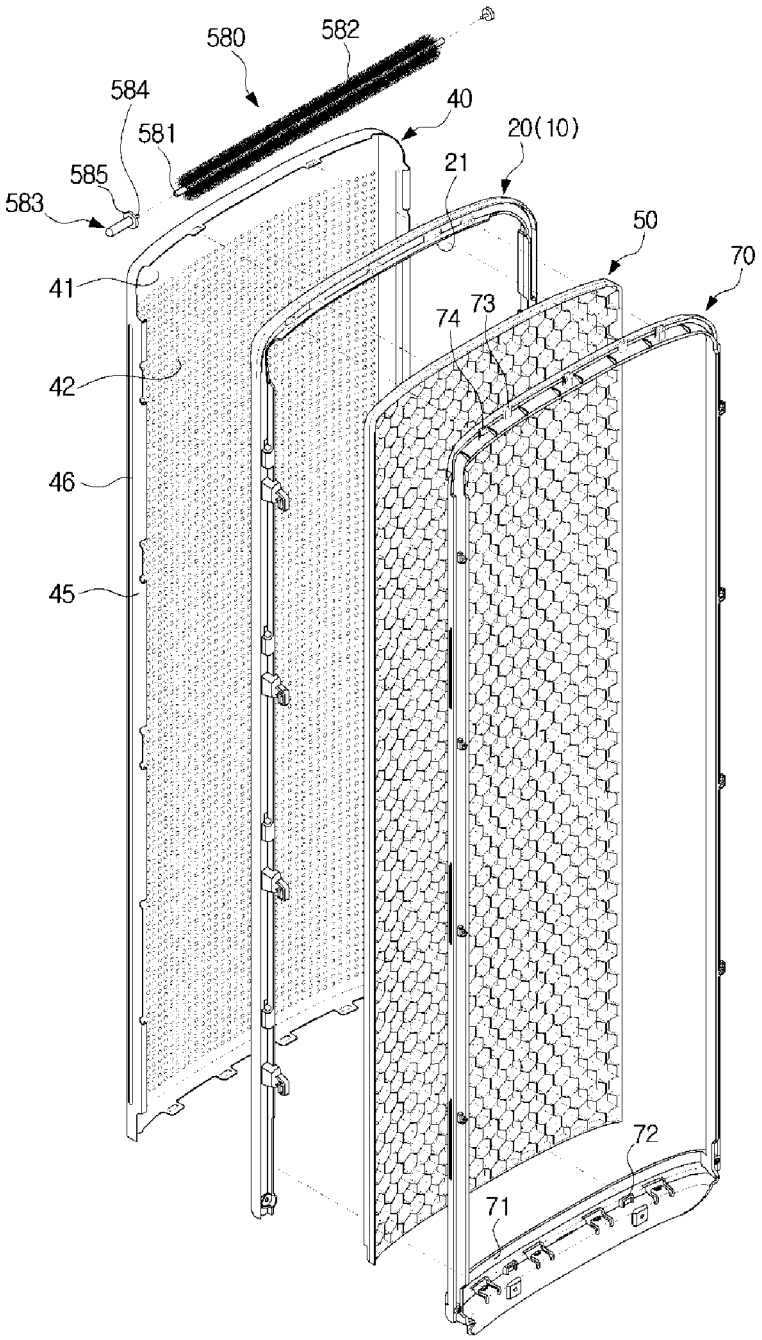
FIG. 13 is an exploded perspective view of main configurations of an air conditioner having a cleaning brush capable of cleaning a rear surface of a discharge panel according to another embodiment of the present disclosure.
Figure 14:
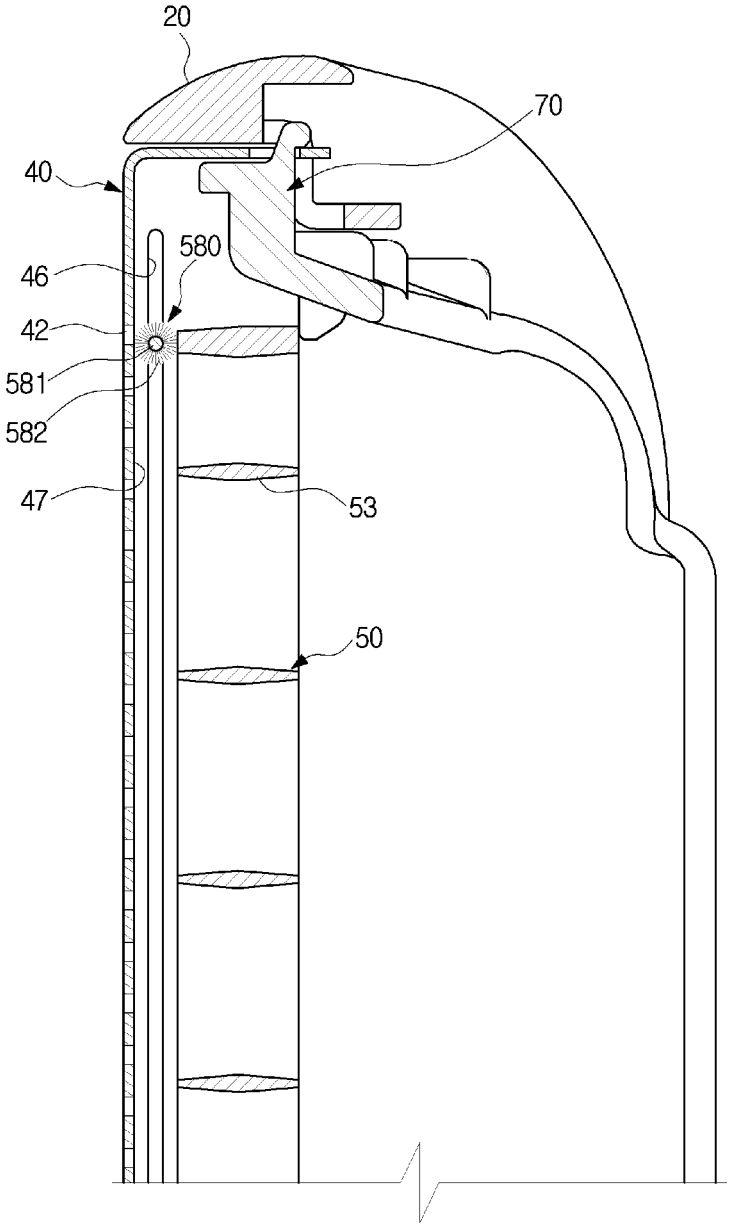
FIG. 14 is a side sectional view illustrating the relationship between the discharge panel and the cleaning brush of the air conditioner in FIG. 13.

FIG. 13 is an exploded perspective view of main configurations of an air conditioner having a cleaning brush capable of cleaning a rear surface of a discharge panel according to another embodiment of the present disclosure, and FIG. 14 is a side sectional view illustrating the relationship between the discharge panel and the cleaning brush of the air conditioner in FIG. 13.

Hereinafter, the structure of a cleaning brush capable of easily cleaning the discharge panel 40 will be described with reference to FIGS. 13 and 14. The same reference numerals are given to the same components as those of the above-described embodiments, and description thereof may be omitted.

Since the discharge panel 40 is coupled to the front panel 20, the reinforcing member 50 and the support frame 70, it is not easy for the user to separate the discharge panel 40 from these components. Even if the user has separated the discharge panel 40 from these components, it is cumbersome and not easy for the user to again couple the discharge panel 40 to these components.

Further, a rear surface of the discharge panel 40 may not be cleaned without separating the discharge panel 40 from these components.

Accordingly, according to the present embodiment, the air conditioner 1 may further include a cleaning brush 580 provided at a rear of the discharge panel 40 so that a rear surface 47 of the discharge panel 40 may be easily cleaned without separating the discharge panel 40 from the front panel 20, the reinforcing member 50 and the support frame 70, that is, in a state in which the discharge panel 40 is coupled with the front panel 20, the reinforcing member 50 and the support frame 70.

The cleaning brush 580 is disposed between the discharge panel 40 and the reinforcing member 50 and may be configured to be movable in a vertical direction. To this end, guide grooves 46 may be formed long in a vertical direction on opposite sides 45 of the discharge panel 40 so as to guide the movement of the cleaning brush 580.

The cleaning brush 580 may include a brush shaft 581 provided to be inserted into the guide grooves 46 and brush bristles 582 provided on an outer circumferential surface of the brush shaft 581. The brush bristles 582 are provided to be in contact with the rear surface 47 of the discharge panel 40 so as to clean the rear surface 47 of the discharge panel 40. The cleaning brush 580 may include separation preventing portions 585 having a greater thickness than the guide grooves 46 so that the cleaning brush 580 is not separated from the guide grooves 46.

The cleaning brush 580 may be manually operated by the user. To this end, the cleaning brush 580 may include a handle 583 that may allow for the user to hold the cleaning brush 580 and move it up and down. A coupling protrusion 584 may be formed on the handle 583. The coupling protrusion 584 may be inserted into the brush shaft 581 to couple the handle 583 to the brush shaft 581.

As described above, according to the embodiments of the present disclosure, even if the discharge panel 40 is not detached, dust and the like on a rear surface of the discharge panel 40 may be easily cleaned by the user holding the cleaning brush 580 and moving the cleaning brush 580 in the vertical direction. Therefore, clogging of the discharge holes 42 of the discharge panel 40 by dust and the like may be prevented, and the reliability of the air conditioner may be improved.

As is apparent from the above, the air conditioner according to an embodiment of the present disclosure can discharge air in various ways because the air conditioner includes a first discharge port at which the discharge panel having a plurality of discharge holes is disposed and a second discharge port through which air can be blown.

The air conditioner according to an embodiment of the present disclosure can prevent the discharge panel having a plurality of discharge holes from being deformed due to pressing or the like.

The air conditioner according to an embodiment of the present disclosure can prevent the inside of the air conditioner from being exposed through the plurality of discharge holes of the discharge panel.

The air conditioner according to an embodiment of the present disclosure can easily clean the discharge panel.

Although a few embodiments of the present disclosure have been shown and described, it would be appreciated by those skilled in the art that changes may be made in these embodiments without departing from the principles and spirit of the disclosure in the scope of which is defined in the claims and their equivalents.

What is claimed is:

1. An air conditioner comprising:

a housing having a suction port and a discharge port;

a heat exchanger to exchange heat with air flowing into the housing;

a fan configured to discharge the heat exchanged air out of the housing;

a discharge panel disposed at the discharge port and having a plurality of discharge holes arranged on a panel surface of the discharge panel; and a reinforcing panel disposed between the heat exchanger and the discharge panel so as to guide air that has passed through the heat exchanger to the discharge panel, wherein the reinforcing panel is adjacent to the discharge panel and spaced apart from the discharge panel by a gap, and the gap is of a size which allows the panel surface of the discharge panel to contact the reinforcing panel when the panel surface of the discharge panel is depressed by an external pressure, to thereby restrict a depression amount of the panel surface of the discharge panel, the reinforcing panel includes a plurality of unit cells continuously arranged to be adjacent to each other on one plane, each of the unit cells includes a partition and a through hole formed to be surrounded by the partition, and, when the panel surface of the discharge panel is depressed by the external pressure, the panel surface of the discharge panel contacts at least one partition of at least one unit cell, to thereby restrict the depression amount of the panel surface of the discharge panel.

2. The air conditioner according to claim 1, wherein:

a cross-sectional area of the through hole is within a range of 5 to 10 times a cross-sectional area of the discharge hole.

3. The air conditioner according to claim 1, wherein:

the unit cells have one of a hexagonal shape, a rectangular shape, and a triangular shape.

4. The air conditioner according to claim 1, wherein:

the reinforcing panel includes a reinforcing portion having the plurality of unit cells, and a frame portion formed at an edge of the reinforcing portion.

5. The air conditioner according to claim 1, further comprising:

a support frame coupled to an edge of the reinforcing panel to fix and support the reinforcing panel.

6. The air conditioner according to claim 5, wherein:

the support frame includes a front support portion protruding to support a front surface of the reinforcing panel and a rear support portion protruding to support a rear surface of the reinforcing panel.

7. An air conditioner comprising:

a housing having a suction port and a discharge port;

a heat exchanger to exchange heat with air flowing into the housing;

a fan configured to discharge the heat exchanged air out of the housing;

a discharge panel disposed at the discharge port and having a plurality of discharge holes arranged on a panel surface of the discharge panel; and a reinforcing panel disposed between the heat exchanger and the discharge panel so as to guide air that has passed through the heat exchanger to the discharge panel, wherein the reinforcing panel is adjacent to the discharge panel and spaced apart from the discharge panel by a gap, and the gap is of a size which allows the panel surface of the discharge panel to contact the reinforcing panel when the panel surface of the discharge panel is depressed by an external pressure, to thereby restrict a depression amount of the panel surface of the discharge panel, and the reinforcing panel includes through holes and a louver configured to be rotatable to open and close the through holes, the reinforcing panel, including the through holes and the louver, thereby being configured to restrict a depression amount of the panel surface of the discharge panel when the panel surface of the discharge panel is depressed by an external pressure and to guide air that has passed through the heat exchanger to the discharge panel.

8. An air conditioner comprising:

a housing having a suction port and a discharge port;

a heat exchanger to exchange heat with air flowing into the housing;

a fan configured to discharge the heat exchanged air out of the housing;

a discharge panel disposed at the discharge port and having a plurality of discharge holes arranged on a panel surface of the discharge panel; and a reinforcing panel disposed between the heat exchanger and the discharge panel so as to guide air that has passed through the heat exchanger to the discharge panel, wherein the reinforcing panel is adjacent to the discharge panel and spaced apart from the discharge panel by a gap, and the gap is of a size which allows the panel surface of the discharge panel to contact the reinforcing panel when the panel surface of the discharge panel is depressed by an external pressure, to thereby restrict a depression amount of the panel surface of the discharge panel;

the reinforcing panel includes a plurality of louvers arranged in a vertical direction, and the louvers are configured to be rotatable up and down about a rotation shaft disposed in a horizontal direction, the reinforcing panel, including the plurality of louvers, thereby being configured to restrict a depression amount of the panel surface of the discharge panel when the panel surface of the discharge panel is depressed by an external pressure and to guide air that has passed through the heat exchanger to the discharge panel.

* * * * *